US011715342B2

(12) United States Patent
Nguyen et al.

(10) Patent No.: US 11,715,342 B2
(45) Date of Patent: Aug. 1, 2023

(54) VIDEO SLOT GAMING SCREEN CAPTURE AND ANALYSIS

(71) Applicant: Caesars Enterprise Services, LLC, Las Vegas, NV (US)

(72) Inventors: Thompson Nguyen, Las Vegas, NV (US); Jayendu Sharma, Las Vegas, NV (US); Joshua Frank, Las Vegas, NV (US); Gene Lee, Las Vegas, NV (US)

( * ) Notice: Subject to any disclaimer, the term of this patent is extended or adjusted under 35 U.S.C. 154(b) by 0 days.

(21) Appl. No.: 16/704,489

(22) Filed: Dec. 5, 2019

(65) Prior Publication Data

US 2020/0184765 A1 Jun. 11, 2020

Related U.S. Application Data

(60) Provisional application No. 62/775,504, filed on Dec. 5, 2018.

(51) Int. Cl.
*G07F 17/32* (2006.01)
*G07F 17/34* (2006.01)

(52) U.S. Cl.
CPC ..... *G07F 17/3213* (2013.01); *G07F 17/3234* (2013.01); *G07F 17/34* (2013.01)

(58) Field of Classification Search
CPC ..... G07F 17/3202; G07F 17/3206; G07F 17/3209; G07F 17/3213; G07F 17/3225; G07F 17/3232; G07F 17/3234; G07F 17/3237; G07F 17/3239; G07F 17/3241
USPC ..... 463/29
See application file for complete search history.

(56) References Cited

U.S. PATENT DOCUMENTS 5,605,334 A * 2/1997 McCrea, Jr. ..... A63F 1/14 273/309
6,926,605 B2 * 8/2005 Nguyen ..... G07F 17/3202 463/16
7,771,271 B2 * 8/2010 Walker ..... G07F 17/3227 463/25
2002/0151361 A1 10/2002 Goden et al.
2003/0027631 A1 2/2003 Hedrick et al.
(Continued)

OTHER PUBLICATIONS

The SAS Data Science Blog, "Understanding object detection in deep learning", published Nov. 19, 2018, 10 pages.
(Continued)

*Primary Examiner* — Steven J Hylinski
(74) *Attorney, Agent, or Firm* — Greenberg Traurig, LLP

(57) ABSTRACT

A camera captures a display of a gaming device and determines information that appears on the display. The camera is mounted on a video gaming device, and the camera continuously or at various intervals captures images of the screen of the video gaming device. Those images are analyzed to determine information displayed on the video gaming device, such as game speed (e.g., time between handle pulls, total time of play, handle pulls during a session, etc.), bet amounts, bet lines, credits, etc. This information may be determined in various ways, such as by using image processing of images captured by the camera. Machine learning algorithms may also be used to infer key information displayed on the screen of the video gaming device to capture and/or analyze. A housing of the camera may also have a secondary display oriented in a similar direction as the screen of the video gaming device.

5 Claims, 11 Drawing Sheets

(56) References Cited

U.S. PATENT DOCUMENTS

2003/0060280 A1* 3/2003 Oles ..... G07F 17/3202 463/29
2003/0228906 A1* 12/2003 Walker ..... G07F 17/3244 463/40
2004/0053674 A1* 3/2004 Nguyen ..... G07F 17/3216 463/20
2004/0106449 A1* 6/2004 Walker ..... G07F 17/32 463/25
2005/0164784 A1 7/2005 Yamamoto et al.
2005/0272501 A1* 12/2005 Tran ..... G07F 17/3241 463/29
2006/0243798 A1* 11/2006 Kundu ..... G06Q 20/4016 235/383
2009/0264196 A1* 10/2009 Fujimoto ..... G07F 17/32 463/31
2009/0270170 A1* 10/2009 Patton ..... G07F 17/3206 463/36
2011/0128382 A1* 6/2011 Pennington ..... G07F 17/32 348/153
2011/0207531 A1* 8/2011 Gagner ..... G07F 17/3255 463/30
2013/0165199 A1 6/2013 Lemay et al.
2013/0281207 A1 10/2013 Lyons et al.
2015/0262015 A1* 9/2015 Oguchi ..... G06F 16/786 382/103
2015/0278988 A1 10/2015 MacMillan et al.
2016/0019748 A1 1/2016 Lemay et al.

OTHER PUBLICATIONS

Written Opinion of International Application No. PCT/US2019/064710, dated Feb. 6, 2020, 21 pages.
Search Report of International Application No. PCT/US2019/064710, dated Feb. 6, 2020, three (3) pages.

* cited by examiner

700

900

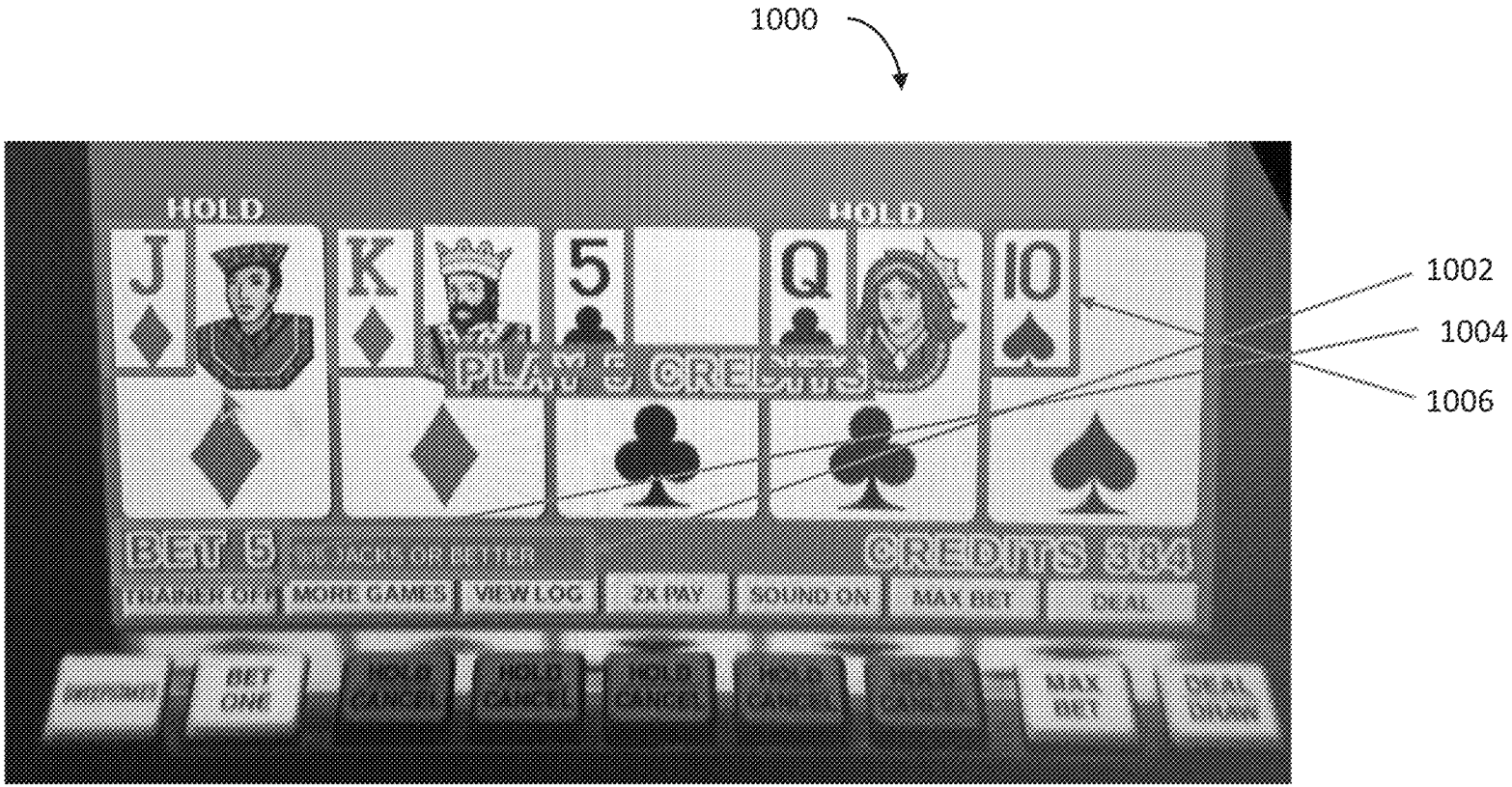
1000
1002
1004
1006
HOLD
HOLD
HOLD
CREDIT
CREDIT
CREDIT

VIDEO SLOT GAMING SCREEN CAPTURE AND ANALYSIS

CROSS-REFERENCE TO RELATED APPLICATION

This application claims the benefit of U.S. Provisional Patent Application No. 62/775,504, filed Dec. 5, 2018, the entire contents of which is hereby incorporated by reference in its entirety.

BACKGROUND

Slot machines, video poker machines, and other gaming devices allow users to participate in a game of chance. Different gaming machines have various displays and interfaces, such as video screens, touch screens, lights, buttons, keypads, spinning or simulated reels, etc.

SUMMARY

The following describes systems, methods, and computer readable media for using a camera to capture a display of a gaming device and determine information that appears on the display. For example, a system may include a camera mounted on a video slot machine, and the camera continuously or at various intervals captures images of the screen of the video slot machine. Those images may be analyzed to determine information displayed on the video slot machine, such as game speed (e.g., time between handle pulls, total time of play by a single user, handle pulls during the total time of play, etc.), bet amounts, bet lines, credits, etc. This information may be determined in various ways. For example, the information may be determined using image processing of images captured by the camera. Machine learning algorithms may also be used to infer key information displayed on the screen of the video slot machine to capture and/or analyze.

In an example, the camera of the system may be placed at the edge of a display of gaming machine, and oriented to point at the display of the gaming machine. An image captured by such a camera may be significantly distorted, so in some examples the raw image captured may be transformed to better reproduce how the display would look to a user of the gaming machine. Such a camera may be used to capture electronic displays, mechanical displays, hybrid electronic/mechanical displays, or any combination thereof. In this way, images of any types of displays, even older machines, may be captured and analyzed.

While the forgoing provides a general explanation of the subject invention, a better understanding of the objects, advantages, features, properties and relationships of the subject invention will be obtained from the following detailed description and accompanying drawings which set forth illustrative embodiments and which are indicative of the various ways in which the principles of the subject invention may be employed.

BRIEF DESCRIPTION OF THE DRAWINGS

For a better understanding of the subject invention, reference may be had to embodiments shown in the attached drawings in which:

FIG. 10 illustrates exemplary game elements of a transformed area of interest of a captured image;

DETAILED DESCRIPTION

With reference to the figures, systems, methods, graphical user interfaces, and computer readable media are hereinafter described for using a camera to capture a display of a gaming device and determine information that appears on the display. For example, a system may include a camera mounted on a video slot machine, and the camera continuously or at various intervals captures images of the screen of the video slot machine. Those images may be analyzed to determine information displayed on the video slot machine, such as game speed (e.g., time between handle pulls, total time of play by a single user, handle pulls during the total time of play, etc.), bet amounts, bet lines, credits, etc. This information may be determined in various ways. For example, the information may be determined using image processing of images captured by the camera. Machine learning algorithms may also be used to infer key information displayed on the screen of the video slot machine to capture and/or analyze.

Figure 1:
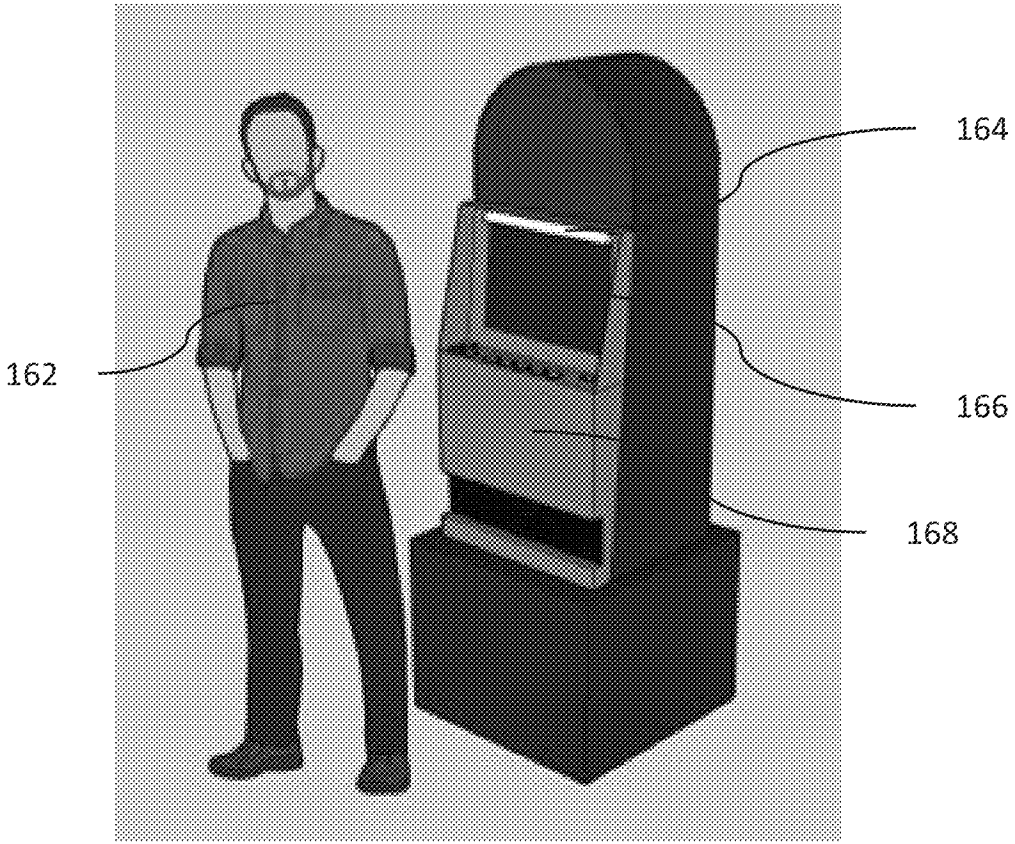
FIG. 1 illustrates an exemplary gaming device and display capture device.

FIG. 1 illustrates an exemplary gaming device 168 and display capture device 164. The gaming device 168 may be, for example, a video slot machine, a video poker machine, video black machine, video baccarat machine, or any other type of gaming device. The gaming device 168 may also have multiple games stored thereon, such that a user 162 may play multiple types of slot games, card games, etc. The gaming device 168 may include a display 166. The display 166 is a video screen. The display 166 may also be interactable with the user 162. For example, the display 166 may be touchscreen. In various embodiments, a display may also include mechanical elements such as buttons, reels, handles, coin slots, etc. Accordingly, the various embodiments described herein of an image capture and analysis system may be used on a strictly mechanical gaming device, a digital gaming device, or any hybrid gaming device that incorporates mechanical and digital components.

The display capture device 164 is mounted at the top of the display 166 in FIG. 1. In various embodiments, the display capture device 164 may be mounted in different locations on the gaming device 168, such as below the display 166 or to one side of the display 166. In various embodiments, the display capture device 164 may also include more than one component mounted on the gaming device 168, such that the display capture device 164 is in multiple orientations with respect to the display 166. In another embodiment, the display capture device 164 or a portion of the display capture device 164 may not be mounted on the gaming device 168. For example, the display capture device 164 or a portion of the display capture device 164 may be mounted on a ceiling in a room where the gaming device 168 is located, on a post or column near the gaming device 168, on another gaming device, or in any other location. In such examples, the display capture device 164 may be oriented such that a camera of the display capture device is pointed toward the gaming device 168 and/or the display 166.

Figure 2:
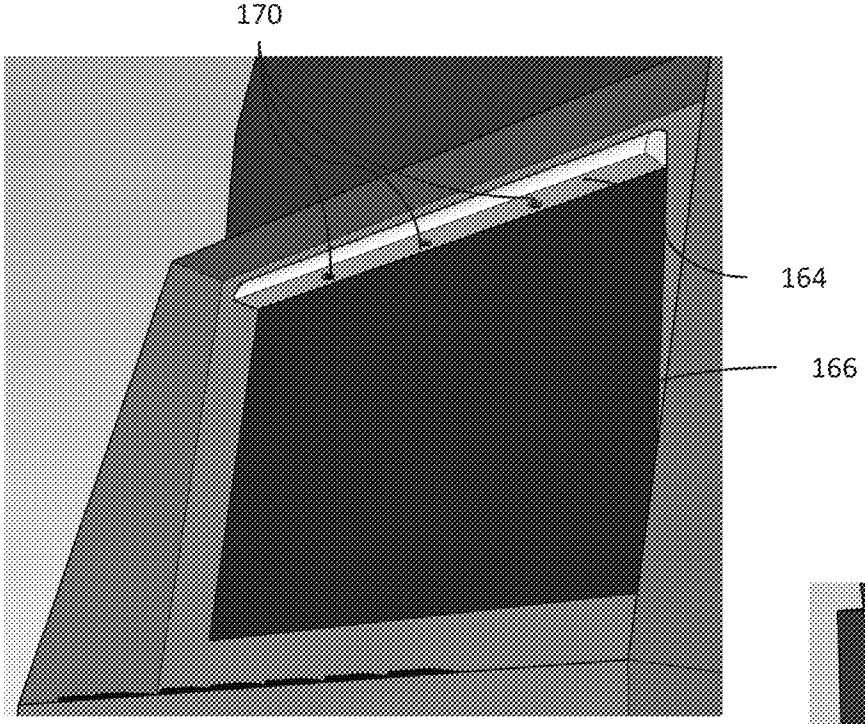
FIG. 2 illustrates an exemplary gaming device display and display capture device with multiple cameras.

FIG. 2 illustrates an exemplary gaming device display 166 and display capture device 164 with multiple cameras 170. The multiple cameras 170 are pointed downward toward the display 166 such that the display 166 may be captured by the multiple cameras 170. In FIG. 2, three cameras are shown in the array of multiple cameras 170. However, in various embodiments, more or less than three cameras may be used. For example, one, two, four, five, six, seven, eight, nine, ten, or more cameras may be used in various embodiments.

Accordingly, using the display capture device 164 as shown in FIG. 2, a processor of the system receives, from the cameras 170, one or more images of the display 166 of the gaming device 168. If multiple images are captured by the multiple cameras 170 at the same time, the images may be spliced together to form a single image representative of the entire display 166. In addition, the cameras 170 may be used to capture multiple images over time, such that continuous monitoring of the display 166 can occur as described herein.

The image(s) captured by the display capture device 164 may be analyzed to determine locations of game elements within the image(s), and determine values of the game elements at the various locations within the image(s). For example, a game element may be a bet amount and the value may be the actual amount bet for a single play. In another example, a game element may be a slot reel (either electronic or mechanical), and the value may be the character, number, or image that appears on a particular portion of the slot reel (and is visible on the display 166). In another example, the game element may be a card, and the value may be the suit and number/value of the card. In another example, the game element may be a hold/draw button or indicator, and the value may be whether the user has selected to hold or draw a particular card. Other game elements and values of those elements may also be located, analyzed, and determined as described herein. This information may be used to determine various aspects of gameplay, such as game speed, how much a user has wagered, lost, and/or won, what types of games are being played, how many lines a user bets on average, and many other game aspects as described herein. These gameplay aspects may be determined through continuous monitoring of the display 166. In other words, multiple images over time may be captured by the display capture device 164 to determine values of elements at a single point in time but also to track play of the game over time using the determined elements and values in aggregate.

Figure 3:
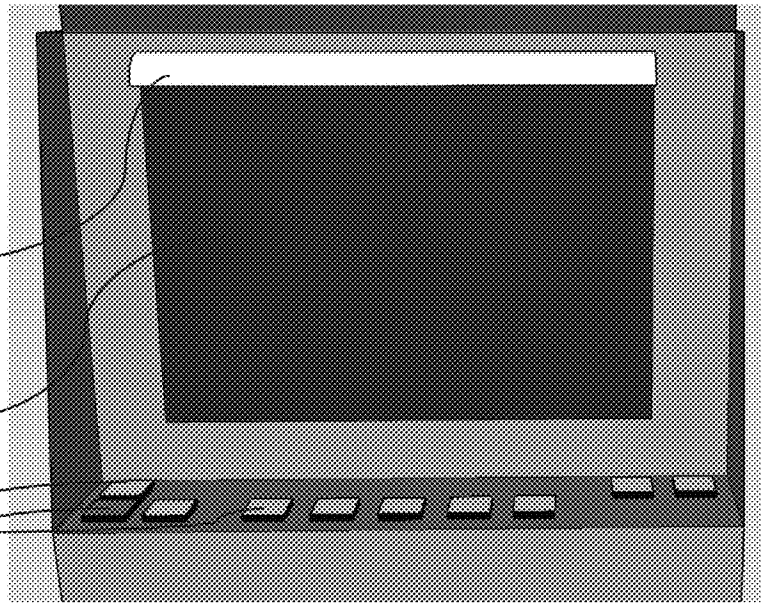
FIG. 3 illustrates an exemplary gaming device display with mechanical input game elements.

FIG. 3 illustrates an exemplary gaming device display 166 with mechanical input game elements 172. In other words, FIG. 3 includes mechanical buttons that may be considered part of the display, and therefore captured by a display capture device, such as the display capture device 164. In this way, image capture using a camera further captures these mechanical input game elements 172 so that they can be analyzed as game elements. For example, in some video poker games, some of the mechanical input game elements 172 are used to indicate whether to hold or draw a particular card. In other examples, the mechanical input game elements 172 may be used to change a bet, execute a bet (e.g., play a game, spin a slot, etc.), or otherwise interact with the gaming device. In such gaming devices, these mechanical input game elements 172 may be captured as part of the display 166 and analyzed according to the various embodiments described herein.

For example, in some embodiments, the mechanical input game elements 172 may have lights inside them that change after being pushed to indicate a state of the button/feature of the game. Accordingly, images captured may be analyzed to determine the state of the button/feature of the game. In some embodiments, when the user engages one of the mechanical input game elements 172, a portion of a video display, such as the display 166, changes to indicate that the mechanical input game element 172 has been engaged. In other words, in some embodiments, the display 166 may be analyzed to determine that one of the mechanical input game elements 172 has been engaged. In some embodiments, the system may analyze an image to determine that the user is actually engaging with one of the mechanical input game elements 172. For example, the image may include a hand or finger of the user pushing a button. Similarly, subsequent images may indicate that a hand or finger of a user has pushed a button or otherwise interacted with one of the mechanical input game elements 172.

In some embodiments, multiple aspects may be utilized to increase the confidence of the system that one of the mechanical input game elements 172 has been interacted with and/or changed states. For example, the system may analyze a captured image or images to determine that a state of one of the mechanical input game elements 172 has changed based on a light in the mechanical input game element, based on an associated portion of the display screen 166 changing, and/or actually observing a user's hand or finger interacting with or appearing near one of the mechanical input game elements 172. Accordingly, the system can determine an interaction with a mechanical input, the state of the mechanical input, or a change in the state of a mechanical input in various ways.

The display capture device of FIG. 3 also includes a second display 174 on the face of the display capture device. This display 174 may be a video display that displays various information to a user of the gaming device. For example, an LED or LCD screen may be used to show the user advertisements, inform the user on games similar to the one they are playing (either on that machine or on other machines within a gaming location), show a user rewards information (e.g., rewards won/accrued by a known user, rewards that a user could be winning/accruing if they sign up for a rewards program), etc. The display 174 is oriented in a similar direction as the display 166, such that a user playing the game can see both display 166 and 174 easily. The display 174 may also be configured such that the display 174 blends with the display 166 to give the user a seamless view between displays.

Figure 4:
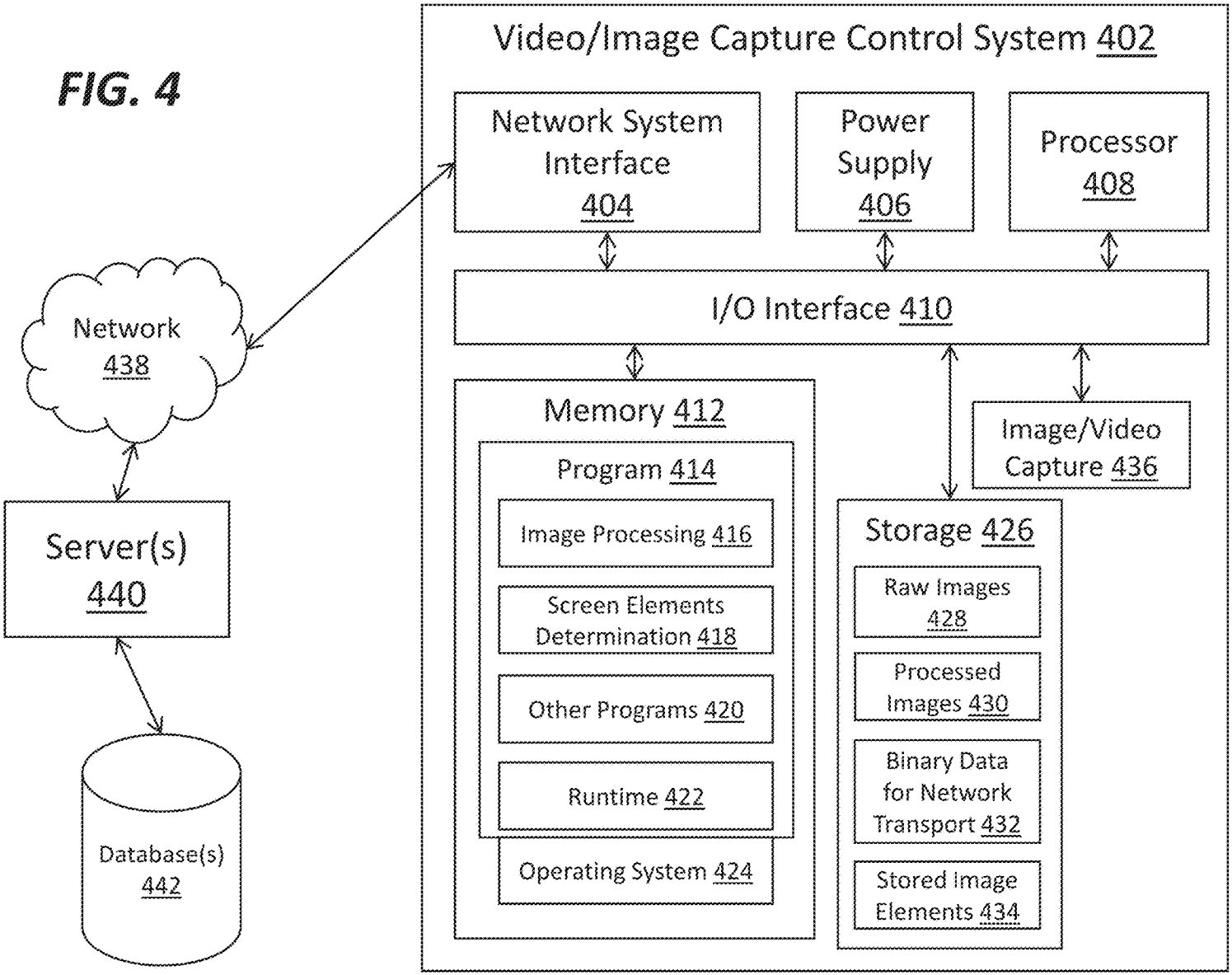
FIG. 4 is a block diagram illustrating an exemplary video/image capture control system for capturing video/images of a display of a gaming device.

FIG. 4 is a block diagram illustrating an exemplary video/image capture control system 402 for capturing video/images of a display of a gaming device. The video/image capture control system 402 may be, for example, the display capture device 164 in FIGS. 1-3. The video/image capture control system 402 communicates with a network through a network system interface 404. The video/image capture control system 402 therefore may communicate with a server(s) 440 through a network 438. The server(s) 440 may further communicate with a database(s) 442 to store various data from the video/image capture control system 402 and/or retrieve information, programs, etc. to send to the video/image capture control system 402. Although only a single video/image capture control system 402, network 438, server(s) 440, and database(s) 442 are shown in FIG. 4, various embodiments may include any number of these aspects. Similarly, in various embodiments, the methods described herein may be performed by or using any of the video/image capture control system 402, the network 438, the server(s) 440, the database(s) 442, or any combination thereof. In one example, a cloud server system may be used, such that the server(s) 440 and the database(s) 442 may represent multiple virtual and actual servers and databases. Accordingly, the methods described herein are not limited to being performed only on the device shown in the example of FIG. 4, nor are the methods described herein limited to being performed on a specific device shown in the example of FIG. 4.

The video/image capture control system 402 further includes an input/output (I/O) interface 410 through which various aspects of the video/image capture control system 402, including the network system interface 404, may interact, send/receive data, receive power, etc. A power supply 406, a processor 408, a memory 412, a storage 426, and an image/video capture 436 are also electrically connected to the I/O interface 410. The power supply 406 may supply power to the various aspects of the video/image capture control system 402. The processor 408 may execute instructions stored on the memory 412, the storage 426, or elsewhere to implement the various methods described herein, such as the methods in FIGS. 4-7 described below. The image/video capture 436 may be a camera or cameras, such as the cameras 170 described above with respect to FIG. 2 used to capture a display of a gaming device.

The memory 412 includes an operating system 424 that provides instruction for implementing a program 414 stored on the memory 412. The program 414 may be implemented by the processor 408, for example, and may include any of the various aspects of the methods described herein for video/image capture and analysis of a gaming device. The program 414 of FIG. 4 may specifically include an image processing aspect 416, a screen elements determination aspect 418, other programs 420, and a runtime system and/or library 422 to assist in the execution of the programs stored on the memory 412 by the processor 408. The image processing aspect 416 may be used to identify an area of interest of a captured image. The image processing aspect 416 may also be used to transform, crop, resize, or otherwise change an image for further processing and/or analysis as described herein. The screen elements determination 418 may be used to identify game elements (e.g., determining a type of game element appearing in a captured image), locations of game elements or potential game elements within a captured image, etc. The image processing aspect 416 may further be used to analyze certain portions identified as game elements by the screen elements determination 418 to identify a value of those elements of the game. Screen elements determination may also use image recognition, optical character recognition (OCR), or other methods to identify game elements, game element types, and/or game element values.

The other programs 420 may include various other programs to be executed by the processor 408. For example, the video/image capture control system 402 may include one or more programs for a machine learning algorithm that may be used to identify an area of interest of a captured image, identify game elements and/or game element types in a captured image, and/or identify values of identified game elements. For example, such a program may include instructions for storing data sets used to train machine learning algorithms. In another example, such a program may include an already trained machine learning algorithm that is implemented to execute a function such as identifying an area of interest of a captured image, identifying game elements and/or game element types in a captured image, and/or identifying values of identified game elements. Other machine learning algorithms may be trained and or implemented to study play patterns of users in general or specific users, such as betting patterns, choices made during gameplay, length of play, etc. In this way, such machine learning algorithms may be trained to recognize specific players or types of players.

The storage 426 may be a persistent storage that includes stored thereon raw images 428 captured by the image/video capture aspect 436, processed images 430 that have been processed by the image processing 416 program, binary data for network transport 432, and stored image elements 434. The binary data for network transport 432 may be sent through the network system interface 404 to other devices. This binary data for network transport 432 may be any of the data determined, inferred, calculated, learned, etc. about a display of a gaming device, behavior of a player, metrics associated with gameplay etc. The binary data for network transport 432 may also represent more raw data relating to the elements determined from analyzed images such that more complex conclusions based on the data may be determined on another device, such as the server(s) 440. The stored image elements 434 may represent known templates for specific game elements that the system is looking for. For example, the stored image elements 434 may include information relating to card shape dimensions, colors, etc. useful for recognizing a card of a card game. In another example, the stored image elements 434 may be used to determine a game type based on comparison to a captured image, and/or may be used to determine areas of interest of a display for a specific gaming device and/or game being played on the gaming device. The stored image elements 434 may also be used to indicate whether a game is powered on or off, and/or whether the game is actually being played or is merely displaying images to attract a player.

Stored image elements 434 may also include image elements relating to specific values of game elements. For example, the stored image elements 434 may include images that appear on the reels of a specific slot game and/or may include the images associated with the four suits of a deck of cards (e.g., clubs, hearts, diamonds, spades) so that the system can use the stored image elements 434 to determine values of identified game elements. In various aspects, the system can add additional stored image elements 434 to the storage 426 as the system learns additional game elements, game element types, game element values, etc. The stored image elements 434 may also include information on where to expect to find certain game elements. For example, the stored image elements 434 may include information indicating that if a video poker game is identified as being played, then card elements, betting elements, and other game elements should appear at certain locations within the display and/or area of interest of the display. Accordingly, the various types of stored image elements 434 and information may be used by the system to better identify game elements, game element types, game element values, etc. In an example, a Raspberry Pi based edge processing system may be used to control and transmit images to a cloud computing system in accordance with the various embodiments described herein. In an example, a Python OpenCV library may be utilized to implement the various embodiments described herein.

Figure 5:
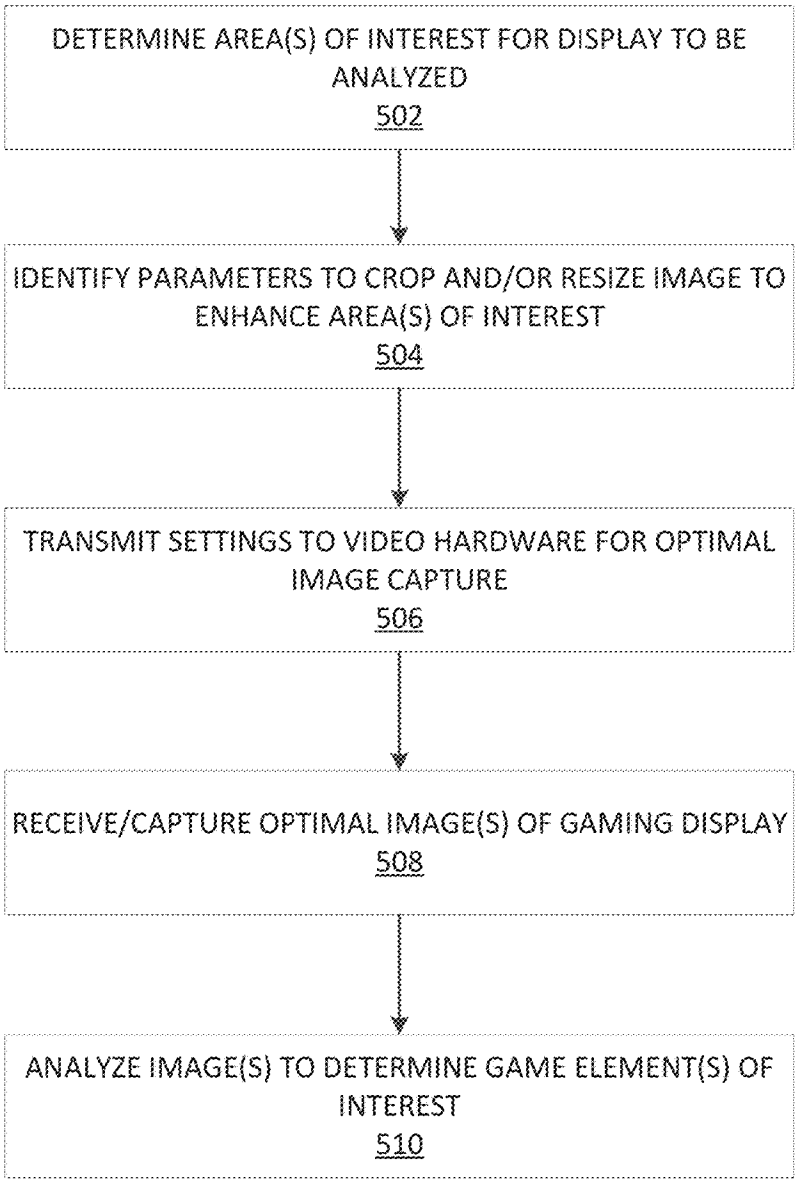
FIG. 5 is a flow diagram illustrating an exemplary method for processing a captured image.

FIG. 5 is a flow diagram illustrating an exemplary method 500 for processing a captured image. In an operation 502, area(s) of interest of a display are determined so that those area(s) may be analyzed by the system. An image capture may include areas that are not of interest for analysis, such as areas outside of a display screen, portions of a display screen that are static or deemed unimportant, etc. A portion of a display may be deemed unimportant if it does not include game elements or does not include game elements that are useful for data capture. By determining the area(s) of interest, the system can focus its processing resources on that portion of an image, conserving computing resources. Additionally, focusing on the area(s) of interest can reduce errors, as the area(s) of interest may be subject to additional processing making game elements, types, and values easier to discern by the system.

In an operation 504, parameters to crop and/or resize an image to enhance area(s) of interest are identified. These parameters may be further determined or identified based on the area(s) of interested determined at the operation 502. In various embodiments, the parameters may be determined based on other information determined by the system. For example, the system may identify text indicating the name or type of a game being played on the gaming device. That game may be associated with known parameters for isolating/enhancing area(s) of interest. In another example, the system may identify an area of interest over time by determining which portions of the display are less static than others (e.g., portions of the display that change more often may be more likely to be important game elements that should be included in an area(s) of interest). Accordingly, the area(s) may be learned over time. In various embodiments, the area(s) of interest may also be learned over time using a machine learning algorithm.

In an operation 506, the parameters identified in the operation 504 are transmitted to video/image capture hardware (e.g., a camera) for optimal image capture. In other words, once the system determines what the area(s) of interest is, the system can adjust the image capture hardware to better capture that area(s) of interest. In this way, the system can capture the area(s) of interest at a higher quality, leading to better results when the area(s) of interest is analyzed for game elements, game element types, and/or game element values. For example, the parameters may include instructions for adjusting a direction the camera is pointed, a focus of the lens, lighting, or any other parameter that impacts a captured image.

In an operation 508, the system receives/captures optimal image(s) of the gaming display, such as a video poker or video slots screen. In an operation 510, the captured image(s) are analyzed to determine game elements of interest. The types and/or values of those game elements may also be determined. The analysis may be performed in various ways as described herein. One example image analysis method to determine game element(s) of interest is described below with respect to FIG. 6. Once an area(s) of interest for a particular game and/or gaming device and parameters for the hardware are determined and set, the system may not perform operations 502, 504, and 506 for subsequent image captures of the same game and/or gaming device because the settings for capturing an area(s) of interest have already been determined. The system may, however, be calibrated to recognize when a machine changes games, such that the operations 502, 504, and 506 may be performed for the new game. However, in some instances, the parameters for the image capture hardware for a particular game may be known, so the system merely determines what game is being played, and the image capture hardware may be adjusted accordingly (or not adjusted if the game uses similar image capture hardware settings as the previous game).

Figure 6:
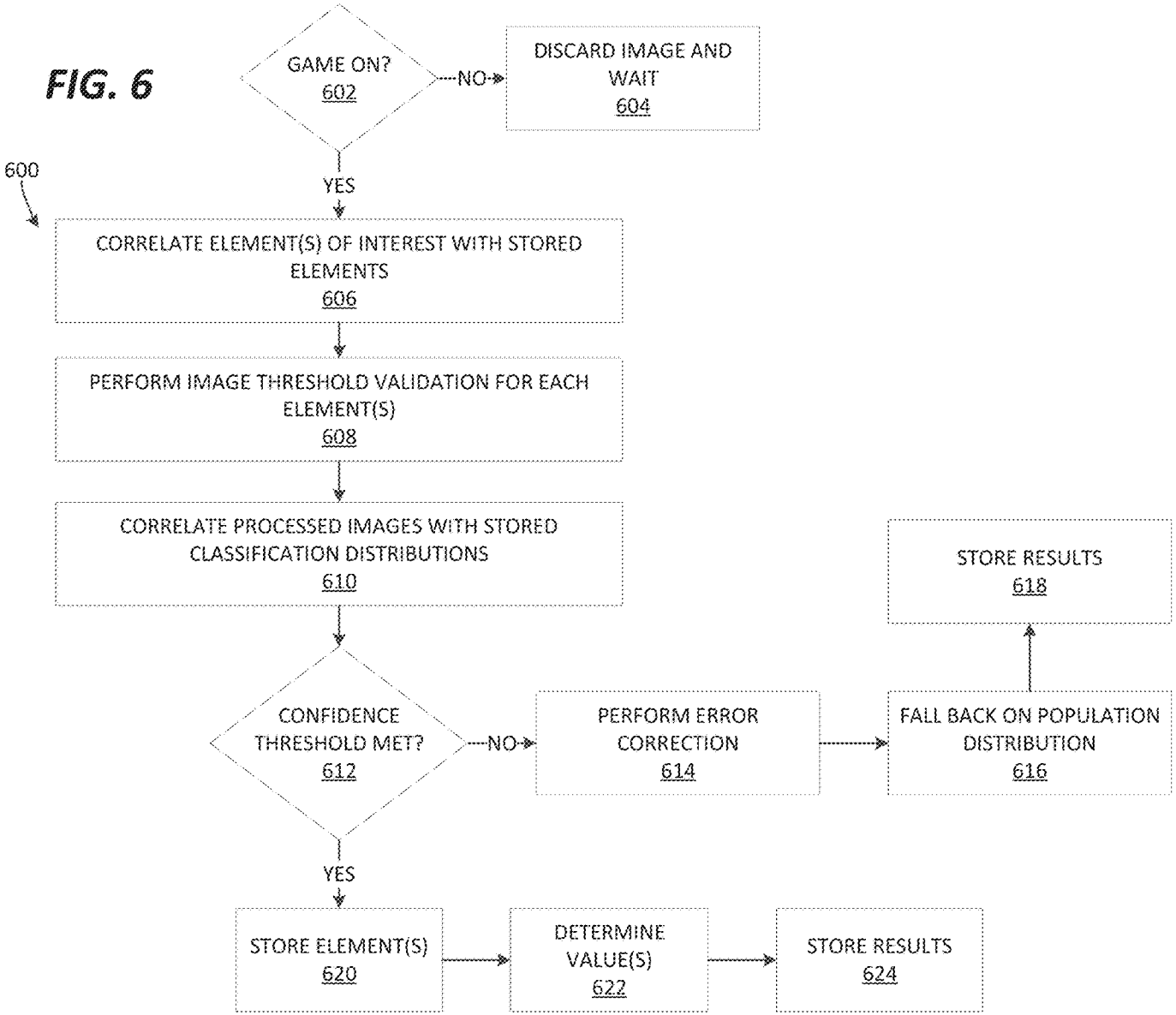
FIG. 6 is a flow diagram illustrating an exemplary method for determining game elements.

FIG. 6 is a flow diagram illustrating an exemplary method 600 for determining game elements. In an operation 602, the system determines whether the game is on or off at least in part based on an image captured. This may be a determination of whether the game is powered on or off, and/or whether someone is actually playing the game or not. Some gaming devices have images that are displayed while the game is not being played meant to attract a player. In this example, these images being displayed to attract a player are considered as the game not being on. When the game is determined to not be on, the captured image is discarded at an operation 604 and the system waits for another image. In some embodiments, the system may capture another image at a set interval, or the system may identify movement in or around the game to indicate that a user may be starting to play the game.

In an operation 606, when the game is determined to be on at the operation 602, element(s) of interest are correlated with stored/known elements. The stored elements may be, for example, stored image elements 434 as described above with respect to FIG. 4. In this way, various portions of the captured image are compared/correlated to the stored elements to determine similarities that may allow the system to determine presence of a game element, game element type, and or game element value. In an operation 608, an image threshold validation process for each of the element(s) of interest is performed. This image threshold validation process determines how similar an element(s) of interest is to a stored element. To perform such a process, various methods may be used. For example, image processing methods may be implemented to determine logical places for bounding boxes to be placed in the captured image. For example, the coloring of the image may indicate a rectangular shape of a playing card, so the system may place a bounding box around the card identifying it as an element of interest. The system may then compare the portion of the image within the bounding box to various stored images to determine if it is similar to any. In particular, the portion of the image in the bounding box will be similar to one or more stored images known to be playing cards. In other words, the image threshold validation process can be used to determine which stored image the portion of the image in the bounding box is most similar too, and/or may be used to make sure that the portion of the image in the bounding box is enough like a particular stored image that it is likely to be of the same game element type.

In an operation 610, the processed image may be correlated with a stored image classification distribution. For example, if the game element is similar to a playing card, the system will know that the playing card game element will be associated with certain classification distributions of values. For example, a playing card of a standard fifty-two (52) card deck will have a one in four chance of being either of the four suits of the deck and will have a one in thirteen chance of being valued between Ace and King. Similarly, the system may know that there are only 52 possible combinations of those values that could appear on a card, and each one of them are as likely to appear as another (unless the system adjusts the odds based on cards it has already identified on the display or as having been used already as part of the same hand/game). Accordingly, the system has a limited number of values it is looking for according to the stored classification distribution known to exist with respect to a playing card.

At an operation 612, the system determines based on the operations 606, 608, and 610 if a confidence threshold is met to accurately identify a game element type and value. If the confidence threshold is met (YES), the element(s) is stored at an operation 620, the value of the element(s) is determined at an operation 622, and the results (values) of the element(s) is stored at an operation 624. These stored elements and results (values), including the element type, may also be sent to another device such as a server. Information regarding the location of a particular game element within the display, such as coordinates, may also be stored and/or transmitted to another device. The confidence threshold that the processed image is the element type and value may also be stored and/or transmitted to another device.

If the confidence threshold is not met at the operation 612, an error correction process 614 is used to attempt to identify the game element type and/or value. The error correction may include various processes, such as further image processing, shifting of bounding boxes, shifting of color profiles of the image, third party queries (e.g., request a server to for a determination of the game element type or value, which may be determined automatically or by a user and sent back), looking forward or backward in captured frames to deduce an element location/type/value, or other error correction methods. If none of the error correction methods work the system may fall back on the population distribution at an operation 616. In other words, even if the confidence threshold is not met at the operation 612, the system may nonetheless assign a classification (game element type) to the game element (portion of the image) that it was most alike or closest to. That assignment may then be stored at an operation 618. Similarly, an assignment determined as a result of the error correction process 614 may also be stored. Information related to the error correction process and whether it was successful (or how successful it was) may also be stored. Information on the confidence levels of various correlations, whether they met a threshold or not, may also be stored. Any information stored during the method 600 of FIG. 6 may also be transmitted to other devices, such as a server or cloud processing system.

In various embodiments, confidence thresholds may be monitored for other purposes. For example, if a system is having trouble accurately locating and determining game element types and values, or if a machine is paying out in a way that is improbable based on odds, problems may be identified from such data. For example, fraud or bugs in a machine, or any other problem, may be identified by monitoring game data. A cloud computing system may also receive large amounts of data from many machines, and utilize deep learning methods to compare machine outputs to detect anomalies that may be indicators of fraud and/or bugs.

Various operations described above with respect to FIG. 6 may be performed using a machine learning algorithm. For example, a game element may be determined to be present within a captured display using a machine learning algorithm trained to recognize a plurality of game element types. This may be used, for instance, instead of or in addition to placing bounding boxes and correlating element(s) of interest with stored elements in the operation 606. In another example, a machine learning algorithm may be utilized instead of or in addition to classification distributions to determine a value of a game element. In various embodiments, a trained machine learning algorithm may be utilized as an error correction process at the operation 614. In other words, the trained machine learning algorithm may be utilized to increase the confidence threshold of the determined game element type and values, so that those determined values may be a YES at the operation 612. In various embodiments, the game element types and/or values determined using the various operations described above with respect to FIG. 6 may also be used as data points to train a machine learning algorithm.

Figure 7:
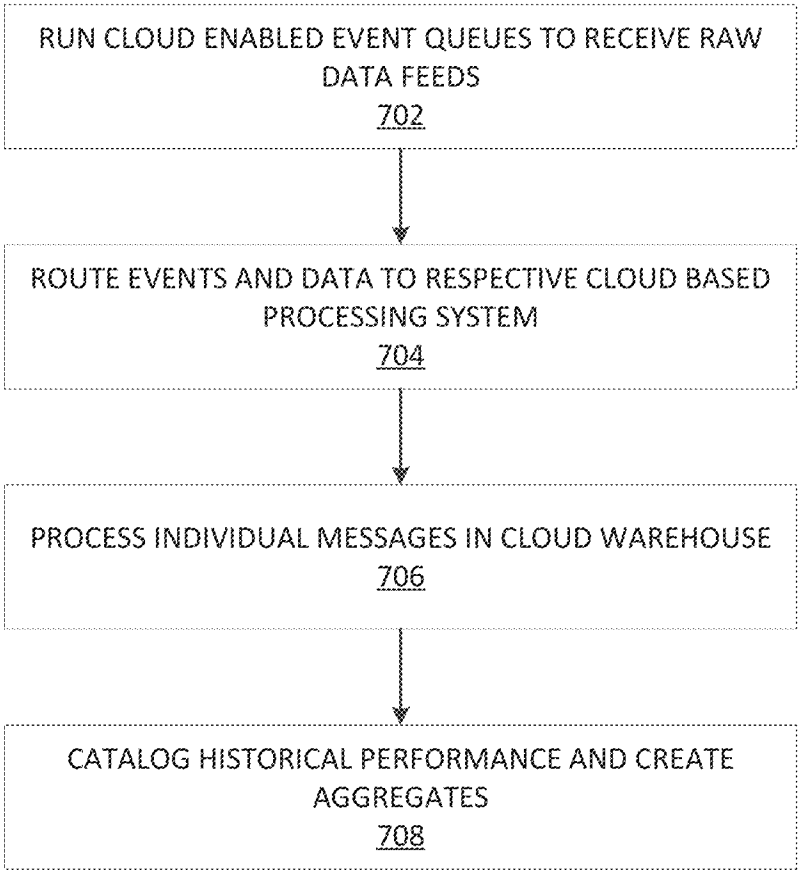
FIG. 7 is a flow diagram illustrating an exemplary method for processing and receiving data by a cloud processing system.

FIG. 7 is a flow diagram illustrating an exemplary method 700 for processing and receiving data by a cloud processing system. The data received may be any of the data described herein, either captured by a camera (e.g., image data, stored images of known element types/values), determined by the processes herein (e.g., hardware configuration parameters, game element locations within an image, game element types, game element values), inferences and/or calculations made (e.g., game speed, time spent playing, actual game decisions such as bets or hold/draw decisions), or any other type of data. The data may be received, for example, from the video/image capture control system 402, and many other similar devices. For example, within a casino, many gaming devices may have video/image capture control systems installed thereon and can collect and capture data. In another example, gaming devices may exist at various locations that are spread around a municipality, state, country, and/or the world, and data can be processed and received from video/image capture control system installed on all of them.

In an operation 702, cloud enabled event queues are run to receive raw data feeds from the video/image capture control systems. For example, the data pushed from individual capture control systems may be pushed daily, weekly, hourly, or on any other predetermined time schedule. In an operation 704, events and data received are routed to respective cloud based processing systems. For example, data on amounts spent by a particular user may be routed to a rewards cloud based processing system. Data on gaming device usage may be sent to a cloud processing system designed to determine level of profitability of gaming devices. In an operation 706, individual messages form the video/image capture control systems are processed in a cloud warehouse. In an operation 708, historical performance is cataloged and aggregates are created to indicate metrics about certain gaming devices, users, types of users, etc. In an example, a virtual private cloud (VPC) may be used as the cloud computing system. The image capture devices described herein may each have a dedicated connection to such a cloud system. A cloud computing system may also be utilized for various data processing as described herein and deep learning based on the data collected.

Figure 8:
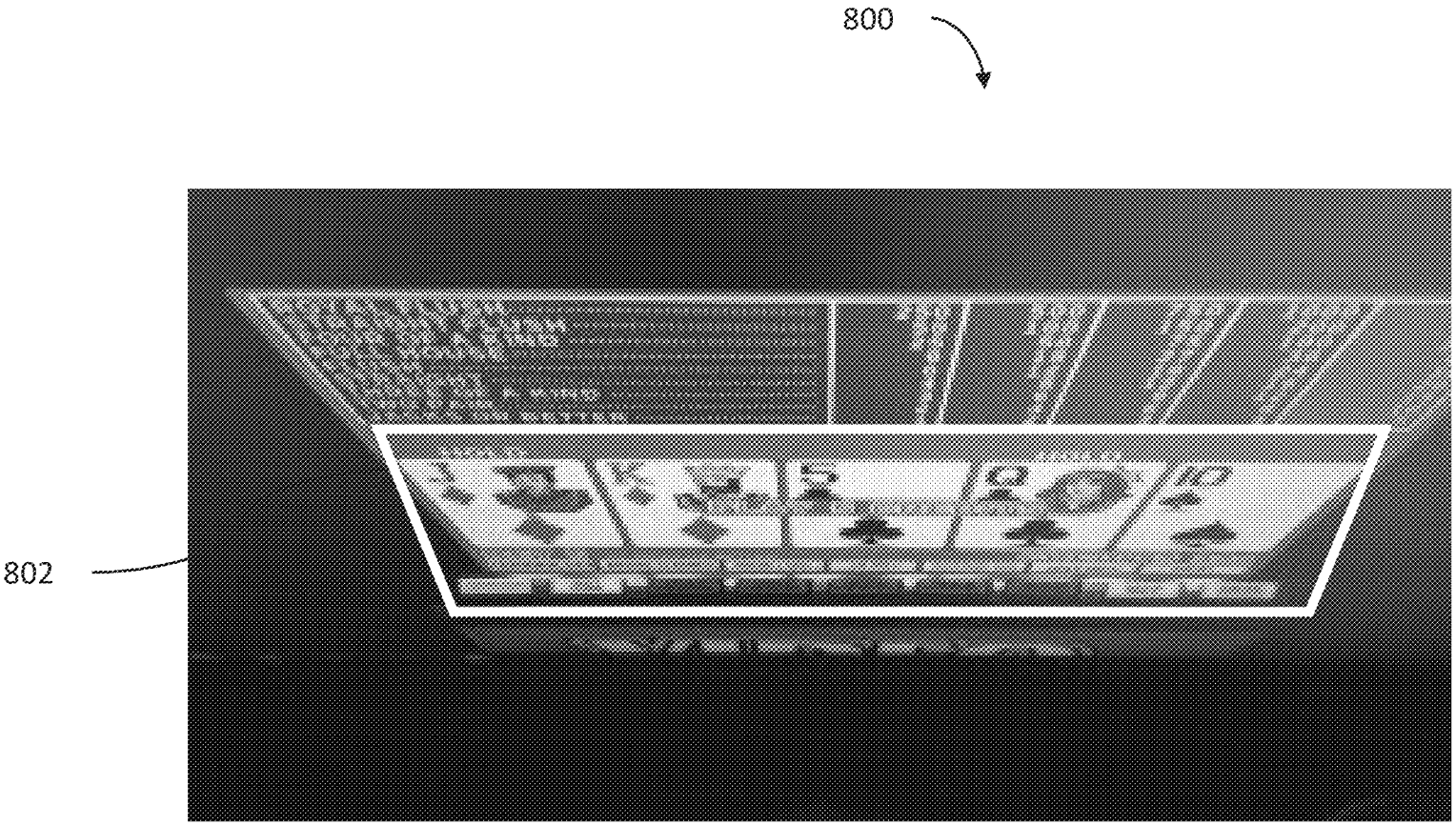
FIG. 8 illustrates an exemplary captured image and an area of interest of the captured image.

FIG. 8 illustrates an exemplary captured image 800 and an area of interest 802 of the captured image. As described herein, the system can use the captured image to determine an area of interest of a captured image. Such a process may include determining a portion of the image that includes the display, but further may include determining a portion of the image that is actually of interest with respect to the game being played. In the example of FIG. 8, the area of interest 802 shows a portion of the display related to a video poker game and mechanical inputs that are being used to play the video poker game. Other areas of the captured image 800 not included in the area of interest 802 include areas that are not part of the display of the gaming device (e.g., to the left and right of the area of interest 802) and areas of the display that are not of importance to the image capture and analysis system (e.g., the portion at the top of the captured image 800 that explains the payouts for the game, the portion at the bottom of the captured image 800 that states the name of the gaming device). As is evidenced by FIG. 8 the camera that captured the image 800 has a line of sight aligned at an acute angle relative to a surface of the captured display, so that the image may be captured without blocking a user's view of the display.

This area of interest 802 may be the area of interest determined with respect to the operation 502 of FIG. 5. Based on the determination of the area of interest 802, the hardware of the image capture system may be adjusted as described with respect to FIG. 5 to better capture the area of interest 802. As part of those parameters, instructions for software processing of the area of interest may also be determined, including resizing, cropping, transforming (e.g., de-skewing), etc. the image, an example of which is described below with respect to FIG. 9.

Figure 9:
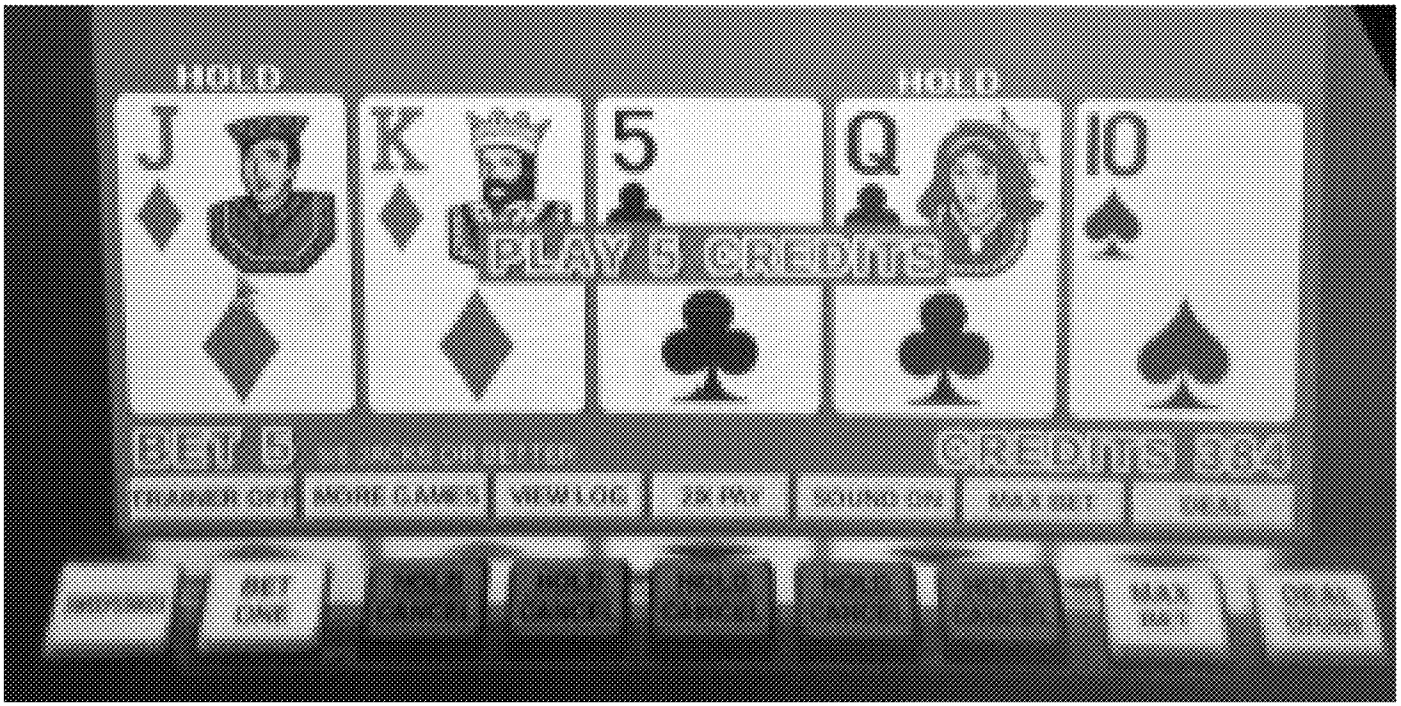
FIG. 9 illustrates an exemplary transformed area of interest of a captured image.

FIG. 9 illustrates an exemplary transformed area of interest 900 of a captured image. As described herein, parameters for capturing and transforming an image may be determined based on a determination of an area of interest. Here, after the area of interest 802 in FIG. 8 was determined, the image 900 is yielded to include the area of interest to process for elements of interest (e.g., according to the process of FIG. 6). The image 900 includes portions of the display of a video screen and portions of a display of mechanical buttons along the bottom of the image 900. Accordingly, the transforming of the area of interest of the image includes transforming the image to approximate the display as the display would be viewed by a user of the gaming device.

FIG. 10 illustrates exemplary game elements of a transformed area of interest 1000 of a captured image. For example, game element 1002 shows a bet amount game element type and a value of five (5) credits. In another example, game element 1004 shows a game name element type and a value of 9/6 jacks or better game type. Game element 1006 shows a playing card game element type with a value of ten (10) of spades. Other playing card game element boxes are also shown. The bounding boxes may be used as described herein to analyze specific portions of the area of interest. That is, the bounding boxes may represent elements of interest as described herein to analyze for game element type and value, such as in the method 600 of FIG. 6. Other various game element identified may include any of a number of betting lines, an indication of one or more particular betting lines, a hold or draw indication, drawn hands, a reel, credits, a payout amount, or any other type of game element.

Other metrics and other methods may be determined as described herein. For example, a game element area of interest, game element type, and or game element value may be determined based on subsequent images of the display to increase the confidence of the system. In some examples, a game element may be obscured, so the system may rely on subsequent images when the game element comes back into view. The system may also determine other aspects of game play based on subsequently captured images, such as a length of time of a single gaming session, start and/or stop times of a single gaming session, times of day a game is popular, metrics related to rated versus unrated play (whether a user is known or not, such as whether the user is enrolled in a rewards program), days of the week particular games are more popular, seasonal metrics, popularity of gaming devices over time, determining skill level of a player, or any other metrics. Such information may be used to adjust floor placement gaming machines, how certain machines are advertised or promoted, the number of certain types of machines used on a casino floor, or for any other purpose.

Figure 12:
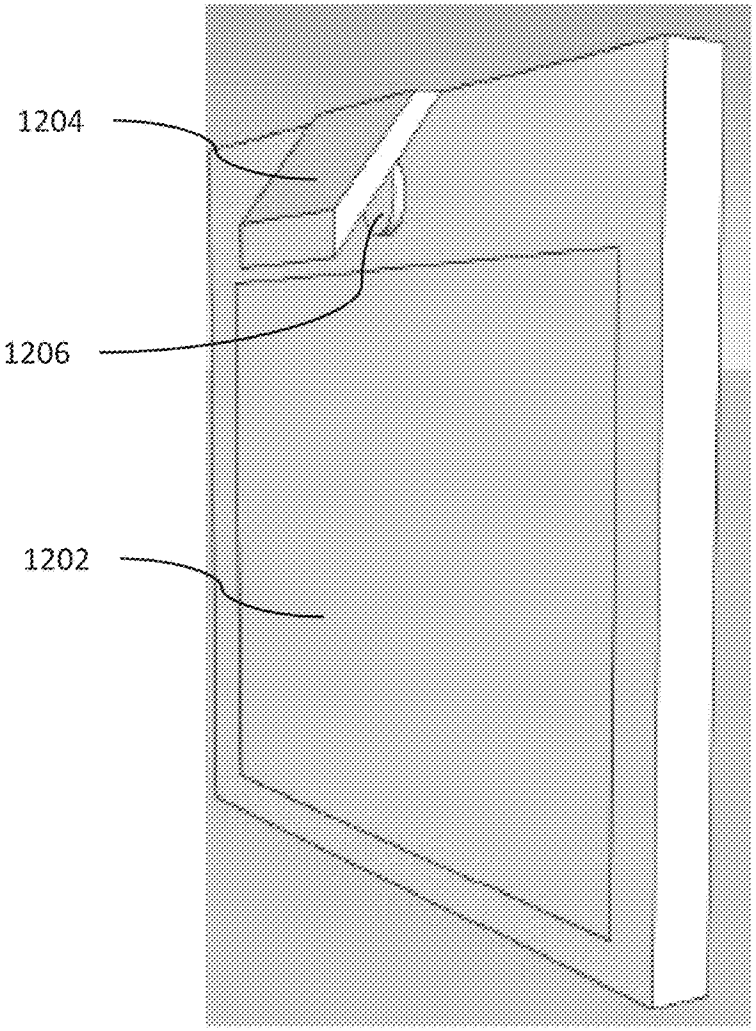
FIGS. 11 and 12 illustrate exemplary gaming device display and display capture device configurations.
Figure 11:
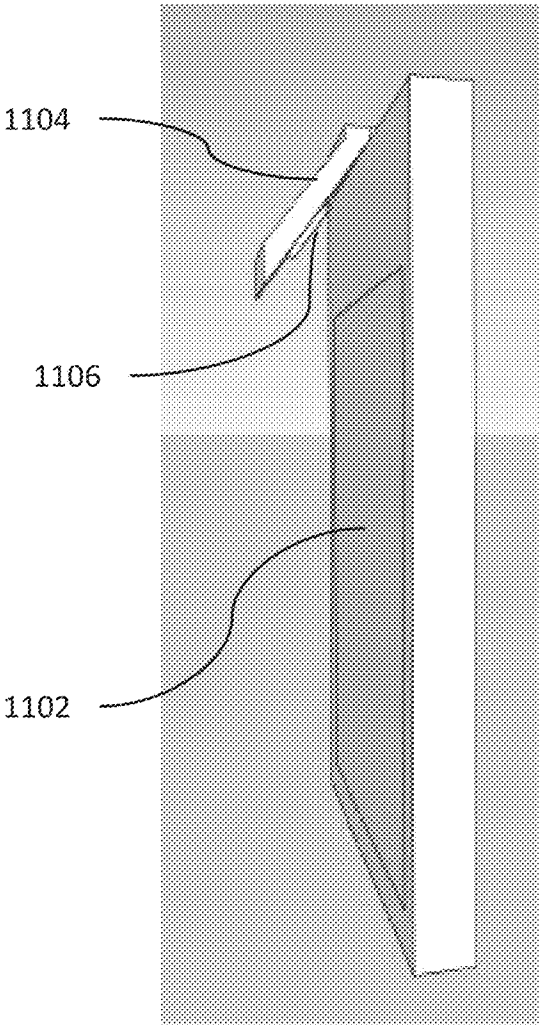

FIGS. 11 and 12 illustrate exemplary gaming device display and display capture device configurations. In FIG. 11, a camera 1106 is located on an extension piece 1104 offset from a display 1102, such that a line of sight of the camera 1106 is oriented at an acute angle with respect to a surface of the display 1102. Since FIG. 11 only has a single camera, a lens of the camera 1106 may be configured such that the camera 1106 captures an entire area of the display 1102.

In FIG. 12, a camera 1206 is located offset from a display 1202, but on a surface parallel and adjacent to the display 1202. A line of sight of the camera 1206 is oriented toward a mirror on an extension piece 1204 offset from the display 1202 and the camera 1206, such that the image captured by the camera 1206 is a reflection of the display in the mirror. The mirror angle and the orientation of the extension piece 1204 may be configured such that the camera may still capture an image of the entire display 1202. In various embodiments, a camera and/or mirror may be configured such that only an area of interest of a display is captured by the camera.

Advantageously, the embodiments described herein provide for data capture of both rated and unrated play. In other words, data capture can occur whether the user of a gaming device is known or not (e.g., whether the user is part of a rewards system). In addition, the embodiments described herein can be installed on gaming devices that do not track usage metrics or have limited usage metric tracking capability, communications capability, or do not track a desired metric.

Figure 13:
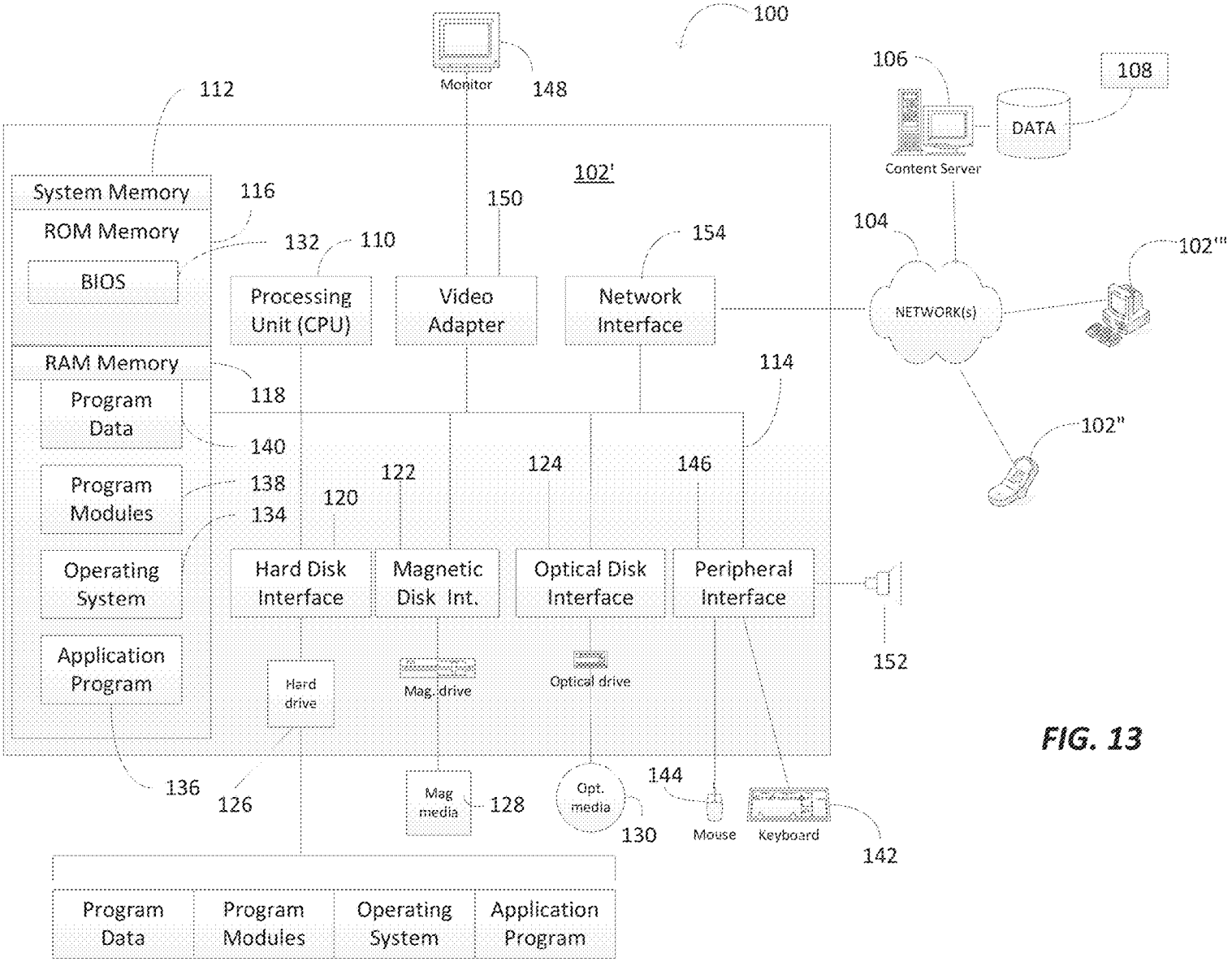
FIG. 13 is a block diagram illustrating components of an exemplary network system in which the methods described herein may be employed.

As illustrated in FIG. 13, a system 100 will be described in the context of a plurality of example processing devices 102 linked via a network 104, such as a local area network (LAN), wide-area network, the World Wide Web, or the Internet. In this regard, a processing device 102' illustrated in the example form of a computer system, a processing device 102" illustrated in the example form of a mobile device, or a processing device 102'" illustrated in the example form of a personal computer provide a means for a user to communicate with a server 106 via the network 104 and thereby gain access to content such as media, data, webpages, an electronic catalog, etc., stored in a repository 108 associated with the server 106. Data may also be sent to and from the processing devices 102 and the server 106 through the network, including captured images, game elements, game values, etc. as described herein. In various embodiments, the methods described herein may be performed by the one or more of the processing devices 102, the server 106, or any combination thereof. Although only one of the processing devices 102 is shown in detail in FIG. 13, it will be understood that in some examples the processing device 102' shown in detail may be representative, at least in part, of the other processing devices 102", 102'", including those that are not shown. The processing devices 102 may, for example, be the video/image capture control system 402 of FIG. 4. The network 104 may, for example, be the network 438 of FIG. 4.

The server 106 and/or the processing devices 102 allow the processing devices 102 to read and/or write data from/to the server 106. Such information may be stored in the repository 108 associated with the server 106 and may be further indexed to a particular game device associated with a processing device 102. The server 106 may, for example, be the server(s) 440 of FIG. 4, and the repository 108 may, for example, be the database(s) 442 of FIG. 4.

For performing the functions of the processing devices 102 and the server 106, the processing devices 102 and the server 106 include computer executable instructions that reside in program modules stored on any non-transitory computer readable storage medium that may include routines, programs, objects, components, data structures, etc. that perform particular tasks or implement particular abstract data types. Accordingly, one of ordinary skill in the art will appreciate that the processing devices 102 and the server 106 may be any device having the ability to execute instructions such as, by way of example, a personal computer, mainframe computer, personal-digital assistant (PDA), tablet, cellular telephone, mobile device, e-reader, or the like. Furthermore, while the processing devices 102 and the server 106 within the system 100 are illustrated as respective single devices, those having ordinary skill in the art will also appreciate that the various tasks described hereinafter may be practiced in a distributed environment involving multiple processing devices linked via a local or wide-area network whereby the executable instructions may be associated with and/or executed by one or more of multiple processing devices. The executable instructions may be capable of causing a processing device to implement any of the systems, methods, and/or user interfaces described herein.

More particularly, the processing device 102', which may be representative of all processing devices 102 and the server 106 illustrated in FIG. 13, performs various tasks in accordance with the executable instructions. Thus, the example processing device 102' includes one or more processing units 110 and a system memory 112, which may be linked via a bus 114. Without limitation, the bus 114 may be a memory bus, a peripheral bus, and/or a local bus using any of a variety of well-known bus architectures. As needed for any particular purpose, the example system memory 112 includes read only memory (ROM) 116 and/or random-access memory (RAM) 118. Additional memory devices may also be made accessible to the processing device 102' by means of, for example, a hard disk drive interface 120, a removable magnetic disk drive interface 122, and/or an optical disk drive interface 124. Additional memory devices and/or other memory devices may also be used by the processing devices 102 and/or the server 106, whether integrally part of those devices or separable from those devices (e.g., remotely located memory in a cloud computing system or data center). For example, other memory devices may include solid state drive (SSD) memory devices. As will be understood, these devices, which may be linked to the system bus 114, respectively allow for reading from and writing to a hard drive 126, reading from or writing to a removable magnetic disk 128, and for reading from or writing to a removable optical disk 130, such as a CD/DVD ROM or other optical media. The drive interfaces and their associated tangible, computer-readable media allow for the nonvolatile storage of computer readable instructions, data structures, program modules and other data for the processing device 102'. Those of ordinary skill in the art will further appreciate that other types of tangible, computer readable media that can store data may be used for this same purpose. Examples of such media devices include, but are not limited to, magnetic cassettes, flash memory cards, digital videodisks, Bernoulli cartridges, random access memories, nanodrives, memory sticks, and other read/write and/or read-only memories.

A number of program modules may be stored in one or more of the memory/media devices. For example, a basic input/output system (BIOS) 132, containing the basic routines that help to transfer information between elements within the processing device 102', such as during start-up, may be stored in the ROM 116. Similarly, the RAM 118, the hard drive 126, and/or the peripheral memory devices may be used to store computer executable instructions comprising an operating system 134, one or more applications programs 136 (such as a Web browser), other program modules 138, and/or program data 140. Still further, computer-executable instructions may be downloaded to one or more of the computing devices as needed, for example, via a network connection.

A user may enter commands and information into the processing device 102' through input devices such as a keyboard 142 and/or a pointing device 144 (e.g., a computer mouse). While not illustrated, other input devices may include for example a microphone, a joystick, a game pad, a scanner, a touchpad, a touch screen, a motion sensing input, etc. These and other input devices may be connected to the processing unit 110 by means of an interface 146 which, in turn, may be coupled to the bus 114. Input devices may be connected to the processor 110 using interfaces such as, for example, a parallel port, game port, firewire, universal serial bus (USB), or the like. To receive information from the processing device 102', a monitor 148 or other type of display device may also be connected to the bus 114 via an interface, such as a video adapter 150. In addition to the monitor 148, the processing device 102' may also include other peripheral output devices such as a speaker 152.

As further illustrated in FIG. 13, the example processing device 102' has logical connections to one or more remote computing devices, such as the server 106 which, as noted above, may include many or all of the elements described above relative to the processing device 102' as needed for performing its assigned tasks. By way of further example, the server 106 may include executable instructions stored on a non-transient memory device for, among other things, presenting webpages, handling search requests, providing search results, providing access to context related services, redeeming coupons, sending emails, managing lists, managing databases, generating tickets, presenting requested specific information, determining messages to be displayed on a processing device 102, processing/analyzing/storing game information from a video/image capture system, etc. Communications between the processing device 102' and the content server 106 may be exchanged via a further processing device, such as a network router (not shown), that is responsible for network routing. Communications with the network router may be performed via a network interface component 154. Thus, within such a networked environment (e.g., the Internet, World Wide Web, LAN, or other like type of wired or wireless network), it will be appreciated that program modules depicted relative to the processing device 102', or portions thereof, may be stored in the repository 108 of the server 106. Additionally, it will be understood that, in certain circumstances, various data of the application and/or data utilized by the server 106 and/or the processing device 102' may reside in the "cloud." The server 106 may therefore be used to implement any of the systems, methods, computer readable media, and user interfaces described herein.

While various concepts have been described in detail, it will be appreciated by those skilled in the art that various modifications and alternatives to those concepts could be developed in light of the overall teachings of the disclosure. For example, while various aspects of this invention have been described in the context of functional modules and illustrated using block diagram format, it is to be understood that, unless otherwise stated to the contrary, one or more of the described functions and/or features may be integrated in a single physical device and/or a software module, or one or more functions and/or features may be implemented in separate physical devices or software modules. It will also be appreciated that a detailed discussion of the actual implementation of each module is not necessary for an enabling understanding of the invention. Rather, the actual implementation of such modules would be well within the routine skill of an engineer, given the disclosure herein of the attributes, functionality, and inter-relationship of the various functional modules in the system. Therefore, a person skilled in the art, applying ordinary skill, will be able to practice the invention set forth in the claims without undue experimentation. It will be additionally appreciated that the particular concepts disclosed are meant to be illustrative only and not limiting as to the scope of the invention which is to be given the full breadth of the appended claims and any equivalents thereof.

What is claimed is:

1. A non-transient computer-readable media having computer executable instructions stored thereon that, upon execution by a processing device, cause the processing device to perform operations comprising:

receiving, from a camera, an image of an electronic display screen of a gaming device;

determining a portion of the image that includes the electronic display screen;

determining a location of a game element displayed on the electronic display screen within the image by:

monitoring the portion of the image that includes the electronic display screen over time; and based on the monitoring, determining that a first area of the electronic display screen is less static than a second area of the electronic display screen, wherein the first area corresponds to the location of the game element; and determining a value of the game element at the location.

2. The non-transient computer-readable media as recited in claim 1, wherein the instructions further cause the computing device to perform operations comprising: transforming the portion of the image that includes the electronic display screen.

3. The non-transient computer-readable media as recited in claim 2, wherein the camera has a line of sight aligned at an acute angle relative to a surface of the electronic display screen.

4. The non-transient computer-readable media as recited in claim 3, wherein the transforming of the portion of the image comprises transforming the image to approximate the electronic display screen as the electronic display screen would be viewed by a user of the gaming device.

5. The non-transient computer-readable media as recited in claim 1, wherein the game element is at least one of:

a bet amount, a number of betting lines, an indication of one or more particular betting lines, a game type, a card, a hold or draw indication, a reel, credits, or a payout amount.

* * * * *